United States Patent [19]

Fuma et al.

[11] Patent Number: 4,814,818

[45] Date of Patent: Mar. 21, 1989

[54] DEVELOPER LAYER FORMING APPARATUS

[75] Inventors: Hiroshi Fuma; Masahiko Itaya; Toshiro Fujimori, all of Hachioji, Japan

[73] Assignee: Konishiroku Photo Industry Co., Ltd., Tokyo, Japan

[21] Appl. No.: 103,847

[22] Filed: Oct. 1, 1987

[30] Foreign Application Priority Data

Oct. 9, 1986 [JP] Japan ..... 61-240715
Oct. 9, 1986 [JP] Japan ..... 61-240716

[51] Int. Cl.[4] ..... G03G 15/08
[52] U.S. Cl. ..... 355/3 DD; 355/14 D
[58] Field of Search ..... 355/3 DD, 14 D, 15

[56] References Cited

U.S. PATENT DOCUMENTS 4,386,577 6/1983 Hosono et al. ..... 355/3 DD X
4,521,098 6/1985 Hosoya et al. ..... 355/15 X

*Primary Examiner*—A. C. Prescott
*Attorney, Agent, or Firm*—Bierman and Muserlian

[57] ABSTRACT

A developer layer forming apparatus having a developer carrying member having a magnet therein and a plate-shaped elastic member having a rubber surface thereon, wherein the rubber surface is in pressure contact with the developer carrying member and one end of the rubber surface projects from the pressure contact point to the upstream of the developer carrying member in the revolving direction. The plate-shaped elastic member is constructed by superposing a metal or a synthetic resin and a rubber material.

11 Claims, 6 Drawing Sheets

DEVELOPER LAYER FORMING APPARATUS

BACKGROUND OF THE INVENTION

1. Field of the Invention:

The present invention relates to improvements in a developer layer forming apparatus for regulating the thickness of a developer layer which is being held on and carried by a developer carrying member in developing means for developing a latent image on an image retainer especially for electrophotography.

2. Description of the Prior Art:

Generally speaking, when a latent image on an image retainer is to be developed with a developer held on and carried by its carrying member, the quality of the image obtained can be improved with a high contrast by reducing the gap between a latent image retainer (which may be referred simply to an "image retainer") and the developer carrying member. If the gap between the image retainer and the developer carrying member is reduced, the contact developing method, in which the image retainer and the developer layer is held in contact for the development, should reduce the amount of the developer, which is to be held on and carried by the developer carrying member, to a small proper range so that the developer may neither be tamped between the image retainer and the developer carrying member nor be broken the latent image or the developed image by the tamping pressure.

Incidentally, the "amount of developer" will be herein defined as the weight of the developer per unit area, which is held on the surface of the developer carrying member.

Moreover, the non-contact developing method, in which the image retainer and the developer layer is held in non-contact state for the development, should also reduce the amount of developer to a small proper range so that the image retainer and the developer layer may not come into contact when the gap between the image retainer and the developer carrying member is reduced.

In the developing method using a two-component developer according to the prior art, for example, the development has been carried out using a developing device having the following structure. A non-magnetic cylindrical member or a non-magnetic belt is used as the developer carrying member, and a magnet is arranged at the opposite side to the developer carrying surface. The arrangement of this magnet may be fixed or movable, i.e., rotatable on a certain axis so long as it is suitable the developing conditions intended.

The magnetic carrier of the developer on the developing carrying member is subjected to the magnetic force of the magnet arranged at the opposite side to the developer carrying member so that it is erected in the form of ear in accordance with the magnetic force of the magnet and the magnetism of the carrier and held on the developer carrying member. On the other hand, the non-magnetic toner is frictionally charged by the friction with the magnetic carrier as a result that it is agitated in the developer reservoir so that the non-magnetic toner and the magnetic carrier acquire charges of opposite polarities and attached to each other by the coulomb force.

Since the magnetic carrier is held on the developer carrying member by the magnetic field of the magnet, too, the non-magnetic toner is also held together with the magnetic carrier on the developer carrying member so that a developer layer composed of the magnetic carrier and the non-magnetic toner is formed on the developer carrying member.

This developer layer is carried to and held on the developer carrying member to develop a latent image on the image retainer.

This developer layer must satisfy the aforementioned minimum conditions that it should neither be tamped in the gap between the image retainer or the developer carrying member nor come into contact with the image retainer. In addition, the developer layer must satisfy the following conditions:

(1) The "fog" phenomenon, in which the toner deposits on the surface of the image retainer other than an image portion, should not appear;

(2) The "carrier deposition" phenomenon, in which the carrier deposits on the image retainer surface, should not appear;

(3) The toner in an amount enough for a sufficient image density should deposit on a latent image portion; and (4) The toner image having deposited should have a gradation capable of reproducing the gradation of the latent image. In order to satisfy these condition, the following items should be within proper ranges:

the physical properties and agitating methods of the developer; the physical properties and relative velocities of the image retainer to the developer layer; means for forming a latent image on the image retainer; the electric biases applied between the image retainer and the developer carrying member; and the magnetic force and the shapes of the magnetic fields of the magnet.

The conditions further include the amounts and thickness of the developer layer on the surface of the developer carrying member, which should be within shorter proper ranges than the aforementioned ones.

In order that the developer layer held on the surface of the developer carrying member may have desired amounts and thickness according to the prior art, a layer thickness regulating plate 205 made of metal or resin is arranged in the vicinity of the surface of a developer carrying member 203, as shown in FIG. 3, so that a developer D may be held on and carried by the surface of the developer carrying member 203 to a developing region through the gap between the layer thickness regulating plate 205 and the surface of the developer carrying member 203.

The developer carrying member 203 is made of a non-magnetic cylinder having a magnet 204 therein, as shown.

In order that the layer thickness of the developer D may be reduced to about 1 mm or less by the method using that layer thickness regulating plate 205, the gap between this plate 205 and the surface of the developer carrying member 203 should be about 0.5 mm or less. The reason for this dimensional restriction will be explained in the following. When the developer D passes through the gap between the layer thickness regulating plate 205 and the developer carrying member 203, it is constricted into a developer layer of high density. After having passed through the gap between the layer thickness regulating plate 205 and the developer carrying member 203, on the contrary, the developer D on its carrying member 203 is erected by the magnetic force of the magnet 204 so that it becomes a developer layer having a lower density. This layer is 1.5 to 3 times as high as that which is passing through the gap between the layer thickness regulating plate 205 and the developer carrying member 203.

An ordinary copying machine or printer for developing and visualizing an electrostatic latent image has an image width of several hundreds mm.

Highly accurate machining and adjustment of the layer thickness regulating plate are not easy but required for evenly and stably setting at about 0.5 mm or less the aforementioned gap between the layer thickness regulating plate and the developer carrying member all over the width of the image.

With this in mind, therefore, we have invented and applied for patent (as Japanese patent application Nos. 34318/1986 and 34319/1986) a method of forming a developer layer by making the use of the fact that a gap sized substantially equal to the particle diameter of a magnetic carrier can be formed between an elastic plate and a developer carrying member, when the developer sneaks between the elastic plate and the developer carrying member, by pushing the elastic plate onto the surface of the developer carrying member.

FIG. 4 is a diagram showing an example of the means for carrying out the method disclosed in the above-specified Patent Applications.

The elastic plate is forced onto the surface of the developer carrying member such that its leading end is directed to the upstream of the developer carrying member. As shown, the developer carrying member 103 is made of a non-magnetic cylinder, and the elastic plate 105 is flattened and made of a metal such as phosphor bronze or stainless steel. If this elastic plate 105 is forced onto the surface of the developer carrying member 103, a wedge-shaped space 110 is formed between the leading end of the elastic plate 105 and the forced contact. If, in this state, the developer carrying member 103 is moved in a predetermined direction, the developer D held on the developer carrying member 103 by the magnetic field of the magnet is partially allowed to enter the wedge-shaped shaped space 110 and partially not allowed but carried to the opposite surface of the elastic plate 105 to the developer carrying member 103. Only the developer D having entered into the wedge-shaped space 110 is carried to the developing region through the gap between the developer carrying member 103 and the elastic plate 105 by the frictional force established itself and the developer carrying member 103. At this time, the amount of the developer allowed to pass through the gap between the developer carrying member 103 and the elastic plate 105 is determined by both the height of the opening of the wedge-shaped space 110 and the line pressure for forcing the elastic plate 105 onto the developer carrying member 103. This determination naturally corresponds to the case in which the aforementioned conditions such as the physical properties and agitating method of the developer and the magnetic field and force of the magnet are fixed.

The developer having entered into the wedge-shaped space 110 through its opening is forced in the converging direction of the wedge-shaped space 110 by both the frictional force, which is generated between the magnetic carrier and the developer carrying member 103 as a result that it is forced onto the developer carrying member 103 by the magnetic field of the magnet arranged inside the developer carrying member 103, and the pressure of the developer D which is being sequentially forced into the wedge-shaped space 110. The developer D thus forced pushes the elastic plate 105 to sneak through the gap between the elastic plate 105 and the developer carrying member 103.

If the distance of the gap between the elastic plate 105 and the developer carrying member 103 is longer in the sneaking region than the size of a particle of carrier, what supports the elastic plate 105 is both the vertical component of the force for pushing the developer D from the back with respect to the elastic plate 105 and the force for erecting the carrier along the magnetic field generated by the magnet.

If, on the contrary, the distance of the gap between the elastic plate 105 and the developer carrying member 103 becomes equal to the particle size of the carrier, the strength of the carrier has to supports the elastic plate 105. In order, therefore, that the gap distance between the elastic plate 105 and the developer carrying member 103 may be smaller than the carrier particle size, it is necessary either to block the sneaking itself of the developer D into the gap between the elastic plate 105 and the developer carrying member 103 or to apply a line pressure capable of breaking the carrier itself. The relation of the gap distance between the elastic plate 105 and the developer carrying member 103 to the line pressure is plotted in FIG. 5. As shown, when the gap distance is equal to the carrier particle size, the gap distance is constant over a wide range of the line pressure upon the elastic plate 105 and the developer carrying member 103 to facilitate the setting of the elastic plate 105.

As stated above, by setting the gap between the elastic plate and the developer carrying member equal to a value corresponding to the carrier particle size when the developer is passed therethrough, the thin developer layer can be formed stably and evenly to make the gap between the image retainer and the developer carrying member smaller than that of the prior art so that images of high quality can be formed.

In the method described above, however, the metal plate of phosphor bronze or stainless steel is used as the elastic plate. As a result, when the magnetic carrier is sandwiched between the developer carrying member 103 and the elastic plate 105, as shown in FIG. 6, its contacts are located at one to three points at the respective sides of the elastic plate 105 and the developer carrying member 103 and its contact diameters are one five hundredth to one thousandth as small as the particle size to provide a remarkably small area. This increases the force applied per unit area of each contact point so that the magnetic carrier is heated under a high pressure until it is possibly broken into pieces. During the revolution of the developer carrying member, moreover, the toner is heated to a high temperature and broken into fine pieces in case it is sandwiched together with the magnetic carrier, as shown at the righthand side of FIG. 6. These pieces of the toner have a tendency to aggregate after they have been once melted, because the toner is made of a synthetic resin. The toner and magnetic carrier thus broken into finer powdery state than the normal ones are caught at the leading end portion of the elastic plate 105, as shown in FIG. 7, by the physical attraction, when the molten toner solidifies again, to form a sticking deposition 9 as the number of the copying operations increases. As the amount of this deposition increases the more, the opening area of the wedge-shaped space 110 becomes the more smaller so that a sufficient amount of developer cannot be fed to the developer carrying member 103.

Since, moreover, the amount of this sticking deposition is different in accordance with the delicate changes in the conditions such as the surface properties of the elastic plate or the physical properties of the toner, it becomes not even but various in the individual positions taken in the widthwise direction, as shown in FIG. 8. The resultant problem is that streaks are formed in the development.

An experiment was carried out in order to obtain a time until a uniform layer could not be formed due to the increase of the amount of sticking deposition when the thickness or deformed amount of the elastic plate was reduced so that a pressure applied on and a temperature at the toner or carrier in the vicinity of the pressure contact portion of the elastic plate with the developer carrying member were reduced.

Said deformed amount was expressed by a distance from a point where the elastic plate was in contact with the developer carrying member with a pressing force (line pressure) of zero to a point where the fixing portion of the elastic plate fixed on the elastic plate holding member had been moved in order to obtain a predetermined pressing force.

The elastic plate used in this experiment was a phosphor bronze plate, the carrier was a ferrite core coated with acrylic or styrene resin and the toner was a pigment dispersed into a polyester resin etc.

According to the experiment, following results were obtained.

When a time corresponding to several hundreds copies with a line pressure of 2 g/mm had been lapsed a uniform layer could not be formed, but when the line pressure was reduced to 0.2 g/mm a uniform layer could be formed until a time corresponding to one thousand or two thousands copies had been lapsed, and when the line pressure was reduced to 0.02 g/mm a uniform layer could be formed until a time corresponding to ten thousands copies had been lapsed. However, the phosphor bronze plate used for obtaining the line pressure of 0.02 g/mm, for example, was of 0.05 mm in thickness so that it was deformed permanently by a small pressure from the outside and had to be handled very carefully. Further, the deformed amount of the phosphor bronze plate at the contact state was as small as about 0.1 mm with respect to the width or length of the developer carrying member in the axial direction of about 300 mm, so that a very high precision was required for holding the phosphor bronze plate and the sleeve and the manufacturing became difficult.

Accordingly, it is considered that an effective contact area of the elastic plate with the toner or carrier is made large by using an elastic rubber member as an elastic plate in place of the metalic elastic plate to reduce the effective pressure.

Specifically, it is supposed that if the elastic rubber member is used as the elastic plate an effective contact area of the elastic plate with the toner or carrier is more increased and a force per unit contact area or an effective pressure becomes smaller than that of the metallic elastic plate, because the elastic rubber member is deformed according to the figure of the toner or carrier even if the pressure applied on the toner or carrier is not varied. Accordingly, it is expected to reduce the possibility of breakage and melt due to the increased temperature and pressure.

In case, however, the elastic rubber member may have its leading end undulating due to the delicate difference in the mounting method, as shown in FIG. 9, in case the rubber member of not more than 1 mm in thickness and large in width is used. With these undulations, a larger amount of developer is fed at the crests of the undulations whereas a smaller amount of developer is fed at the roots. Then, the development will establish such streaks other than the aforementioned ones as correspond to the undulations.

SUMMARY OF THE INVENTION

An object of the present invention is to provide a developer layer forming apparatus capable of forming a high-quality image without any irregular streak by forming a thin developer layer stably and evenly while preventing the magnetic carrier or toner broken from sticking or depositing on the elastic member acting as developer layer forming means.

In order to achieve the above-specified object, the present invention provides an apparatus for forming a developer layer of a two-component developer having toner particles and magnetic carrier particles comprising: a developer carrying member having a magnet therein; and a plate member having its rubber surface held in pressure contact with said developer carrying member, wherein at least a pressure contact portion of said surface is formed by an elastic rubber member and an end of said surface is projected from the pressure contact portion to the upstream of said developer carrying member in the revolving direction.

The elastic rubber member used herein may be made of styrene-butadiene rubber, solution-polymerized styrene-butadiene rubber, acrylonitrile butadiene rubber, butyl rubber, chloroprene rubber, high cisbutadiene rubber, neoprene rubber, low cis-butadiene rubber, isoprene rubber, fluororubber, ethylenepropylene rubber, chlorosulfonated polyethylenesilicon rubber, urethane rubber, polysulfide rubber, acryl rubber, or natural rubber, and may Preferably be made of urethane rubber. The rubber hardness is 40° to 90° Hs, and preferably 50° to 75° Hs.

The developer layer forming apparatus of the present invention uses the elastic rubber member at least on the contact portion as the layer forming elastic member. FIG. 2 shows in an enlarged scale a portion in which the developer carrying member and the elastic rubber member face each other through the magnetic carrier. In case the elastic member is made of rubber, the rubber contact surface is deformed to some extent in accordance with the shape of the magnetic carrier or the toner, when these carrier or toner comes. As a result, the contact area is enlarged to drop the pressure of the contact portion per unit area, as compared with the case of the metallic elastic member. Moreover, the temperature rise can be suppressed to remarkably reduce the breakage and melt of the magnetic carrier and the toner. This makes it possible to remarkably reduce the phenomenon that the broken pieces of the magnetic carrier and toner will stick to and deposit on the leading end of the elastic member and to form a thin developer layer which is not irregular in the widthwise direction of the developer carrying member but is stable for a long period.

If the force acting between the toner and the elastic rubber member becomes high, on the other hand, the elastic rubber member is highly deformed to have a larger contact area so that the force is not so high per unit area.

As a result, the set value of the force for pressing the elastic plate onto the developer carrying member has a large allowable range.

Another object of the present invention is to provide a developer layer forming apparatus capable of forming a thin developer layer stably without any undulating unevenness in the development even if the elastic rubber member is used.

The present invention provides so as to achieve the above-specified object a developer layer forming apparatus comprises: a developer carrying member having a magnet therein; and a plate-shaped elastic member constructed by superposing a metal or a synthetic resin and an elastic rubber material, wherein the improvement resides in that said plate-shaped elastic member has its rubber material surface held in pressure contact with said developer carrying member and fixed at its other end such that its one end projects by 0.3 to 3.0 mm in length from the pressure contact point to the upstream of said developer carrying member in the revolving direction.

Incidentally, the superposition between the plate-shaped elastic member of metal or synthetic resin and the plate-shaped elastic rubber member may be accomplished by an integral adhesion or merely by plane contact or a line contactperpendicular resin and the plate-shaped elastic rubber member may be accomplished by an integral adhesion or merely by plane contact or a line contact perpendicular to the carrying direction of the developer.

The specific materials for the elastic rubber member used therein are similar to those of the foregoing embodiment. On the other hand, the metal may be exemplified by an elastic metal such as phosphor bronze, stainless steel, copper, or iron (or steel), preferably phosphor bronze and stainless steel and the synthetic resin may be exemplified by polyacetal, ABS, polycarbonate, MIPS, polyamide resin, polybutyrene-terephthalate, polypropyrene, methacryl (PMMA), styrol (PS), polyvinyl chrolide (PVC), polyethylene, polyphenylene oxide (PPO), or styrene copolymer acrylonitrile.

In this embodiment of the developer layer forming apparatus of the present invention, as has been described hereinbefore, the plate-shaped elastic member of the metal or synthetic resin is adhered to or contacts in plane or on line to the opposite surface of the elastic rubber member to that contacting with the developer carrier so that the phenomenon of the undulations does not appear, as is different from the case that only the thin elastic rubber member is used.

The other objects and features of the present invention will become apparent from the following description taken with reference to the accompanying drawings.

DESCRIPTION OF THE PREFERRED EMBODIMENTS

Figure 1:
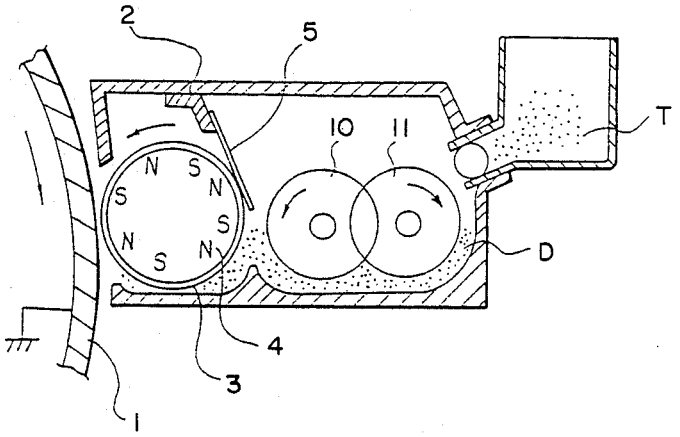
FIG. 1 is a sectional side elevation showing a developing apparatus which is equipped with a developer layer forming apparatus according to the present invention.
Figure 2:
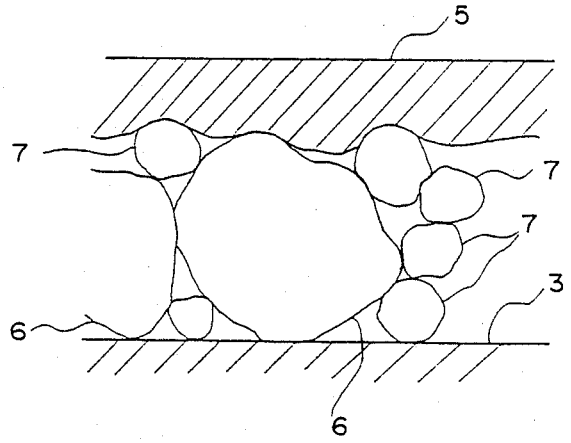
FIG. 2 is a schematic diagram showing that the contact surface of the elastic rubber plate is deformed in accordance with the shapes of the magnetic carrier and the toner.

FIG. 1 is schematic diagram showing the structure of the developing apparatus having the apparatus of the present invention. A non-magnetic sleeve 3 having a magnet roll 4 revolving in the same direction as that of an image retainer 1 carries a developer. The magnet roll 4 has six poles of S and N poles, respectively, which are arranged in an alternate order. The magnetic field on the sleeve surface is generated by the magnet roll 4 having 400 to 700 Gauses. The non-magnetic sleeve 3 is desirably made of rugged stainless steel having a surface roughness of 1 to 10 μm and is exemplified in the present embodiment by a cylindrical sleeve having a roughness of 3 μm and a diameter of 20 mm. The number of revolutions of the non-magnetic sleeve 3 is set at 240 r.p.m., and the number of revolutions of the magnet roll 4 is set at 800 r.p.m., i.e., about 3.3 times as high as the former. An elastic rubber plate 5 is fixed on its holding member 2 and is made of urethane rubber having a hardness of 40°–90° Hs and a thickness of 0.1 to 2.0 mm.

On the other hand, the elastic rubber plate 5 is in contact with the non-magnetic sleeve 3 at 0.3 to 3.0 mm from its free end.

The pressure of the elastic rubber plate 5 per unit axial length of the non-magnetic sleeve 3 is set at 0.2 to 20 g/mm.

As a result, the magnetic carrier and the toner are hardly broken for a long period so that their pieces neither stick to nor deposit on the leading end portion of the elastic member, thus forming a high-quality image having no developing streak.

In case that as the elastic member a rubber having a hardness of 90° Hs brings into contact with a line pressure of about 0.2 g/mm, no sticking deposition of the carrier or toner for preventing the uniform layer formation is occurred while ten thousand copies have been obtained. In case that a rubber having a hardness of 65° Hs is used with the same line pressure the sticking deposition can hardly be found even if an enduration test corresponding to thirty thousand copies is carried out. It is understood through the series studies that it is better to use an elastic rubber member at a portion where at least the elastic member for forming developer layer is in contact with the developer carrying member, preferably with the carrier or toner.

An experiment for obtaining a suitable hardness of elastic rubber member for forming a developer layer was carried out and obtained a result shown in a following Table.

From the Table, it is noted that the hardness of rubber should be 40°-90° Hs, preferably 50°-75° Hs.

TABLE

| rubber hardness | 40° | 50° | 65° | 75° | 90° | 105° |
|---|---|---|---|---|---|---|
| layer formation | Δ | O | O | O | Δ | X |

where the symbol "O" designates good, "Δ" slightly bad and "X" bad.

If the hardness is as small as less than 40° Hs, it is impossible to feed the developer at the contact portion, so that the developer layer can not be formed. If the hardness is more than 90° Hs, the sticking deposition of the toner or carrier is observed. If the hardness is preferably more than 50° Hs, the elastic plate can be made easily and the formation of the developer layer can be continued stably for a long period without causing the abrasion of the elastic plate. If the hardness is less than 75° Hs, the sticking deposition is very small and can be disregarded in comparison with the life time of the apparatus.

However, it is necessary to control the amount of the developer on the developer carrying member in order to form a suitable developer layer actually.

Figure 13:
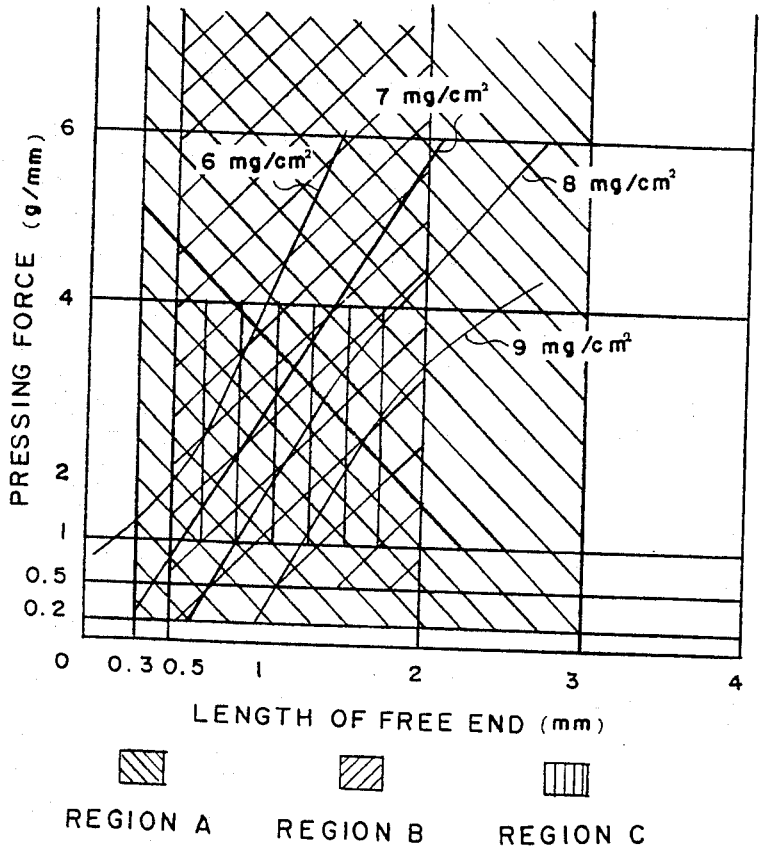
FIG. 13 is a graph showing the relation between a length of free end of the elastic plate and a contact pressure thereof with respect to an amount of the developer.

FIG. 13 is a graph showing the relation between a length of free end, the amount of the developer and the pressing force (line pressure) which is a parameter for determining the amount of the developer on the developer carrying member in case that a urethane rubber of rubber hardness of 65° Hs is used at the contact portion.

The length of free end means a length from the center of the pressure contact portion of the elastic plate with the developer carrying member to a free end of the elastic plate projected from the pressure contact portion to the upstream of said developer carrying member in the revolving direction.

It is necessary to use an amount of the developer of 3-12 mg/cm$^2$, preferably 6-9 mg/cm$^2$ on the developer carrying member for maintaining the non-contact state of the image retainer with respect to the developer layer on the developer carrying member and for obtaining a sufficient developing ability, in case of a developing device wherein a gap between the developer carrying member and the image retainer consisting of a photosensitive member is 0.5 mm, the particle size of the carrier is 40 μm, the particle size of the toner is 15 μm, the toner density is 7 wt%, and the intensity of the magnetic field of the magnet in the developer carrying member measured in the revolving direction of the developer carrying member is 600 Gauss. Here, the particle size is a mean weight particle size.

Accordingly, the elastic plate must be supported in a region A (the length of free end is 0.3-3 mm) in FIG. 13.

However, there is limitations on the application of actual developing device.

Specifically, if the pressing force becomes near 0 g/mm, the deformation of the elastic plate becomes small, so that a very high precision is required for the flatness of the elastic plate. If a thin metal plate etc. is used to reduce the resiliency of the plate in order to avoid the above problem, the plate lacks in strength, so that the manufacturing and the handling of the plate become difficult.

If the elastic plate is once deformed in a direction going away from the developer carrying member in some chance, the elastic plate is held in the deformed position by the developer entered into the wedge-shaped space, so that the developer layer can not be formed. Accordingly, it is required to select the pressing force more than 0.2 g/mm, preferably more than 0.5 g/mm, and more preferably more than 1.0 g/mm. If the pressing force is increased the pressure applied on the developer becomes large, thereby causing the sticking deposition of the carrier or toner which is to be solved by the present invention to be formed, so that the pressing force must be selected less than 20 g/mm, preferably less than 10 g/mm, and more preferably less than 4 g/mm.

If the pressing force is more than 0.5 g/mm unevenness as like as the undulations of the elastic plate are formed in the widthwise direction of the elastic plate (in the axial direction of the developer carrying member) and if it is less than 10 g/mm a little sticking deposition is formed but the replacement of the developing device and the elastic plate becomes unnecessary. If it is more than 1 g/mm a stable formation of the developer layer can be realized by the developing device mass produced. If it is less than 4 g/mm the replacement of the parts etc. are not required and no problem is occurred for the expected life of apparatus.

The length of free end which is an important factor for the formation of the developer layer is 0.3-3 mm, preferably 0.5-2 mm. If it is shorter than 0.3 mm it is difficult to set with high precision in the widthwise direction and if it is longer than 3 mm the new developer is prevented from being fed to the image carrying member with respect to such a requirement that the agitating member and the developer supply member other than the elastic plate must be set in the limited space in the developing device.

If it is longer than 0.5 mm a sufficient precision can be obtained by the normal manufacturing process for the developing device and the mass production can be realized, as well as the formation of the unevenness in the developer layer can be prevented by bending the free end of the elastic plate and processing the edge line thereof. If it is shorter than 2 mm unrequired and obstructing portion of the length of free end can be deleted.

The above limitations are effective to obtain a developing device small in size and compact. Especially, when the diameter of the developer carrying member is less than 50 mm an excellent effect can be obtained by said construction.

Further, the above construction is suitable when the carrier particle size of the developer is 20-80 μm, preferably 30-60μm.

It is desirable to set the length of free end and the pressing force in the region A in FIG. 13, preferably in a region B, most preferably in a region C in order to form a uniform layer of the developer amount of 6–9 mg/cm$^2$.

It can be found in the study of the above that if the elastic plate made of only the urethane rubber of less than 1 mm in thickness is used, a sufficient pressing force can not be obtained due to the small resilience, and the elastic plate is distorted to form undulations by the small error in dimension when the elastic plate is fixed on the mounting means, so that a uniform layer of the developer can not be formed by this elastic plate.

The inventors found that the lack of pressing force and generation of the distortion could be eliminated by backing the elastic rubber plate with a metal plate of phosphor bronze or stainless steel etc. or a resin plate of PET etc. It was further found as an another solution that it was effective to increase the thickness of the elastic rubber member to 1–3mm.

In a method of backing, a metal plate or resin plate etc. for the backing is attached to the elastic rubber plate by using an adhesive, double-coated tape or hot melt etc. Both can be attached in a plane contact form or a line contact form in a direction normal to the surface of the feeding direction of the developer. It is possible to connect the both at one end thereof using an adhesive or by clamping mechanically.

Figure 12:
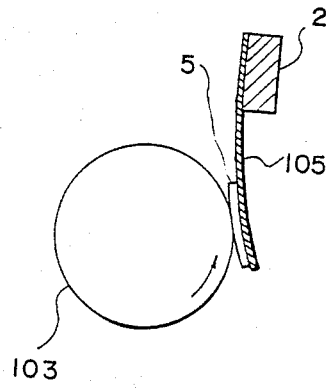
FIG. 12 is a schematic diagram for explaining another embodiment of a developer layer forming member.

It is sufficient that the contact portion of the elastic plate with the carrier or the toner is formed by the elastic rubber member in order to prevent the sticking deposition of the carrier or toner. Accordingly, as shown in FIG. 12, a uniform developer layer formation can be maintained for a long period by attaching an elastic rubber member on a portion of the metal or resin plate.

As stated above, a uniform developer layer formation can be maintained stably for a long period by using as a developing layer forming member under a predetermined condition a metal or resin plate to maintain the linearity thereof.

Figure 10:
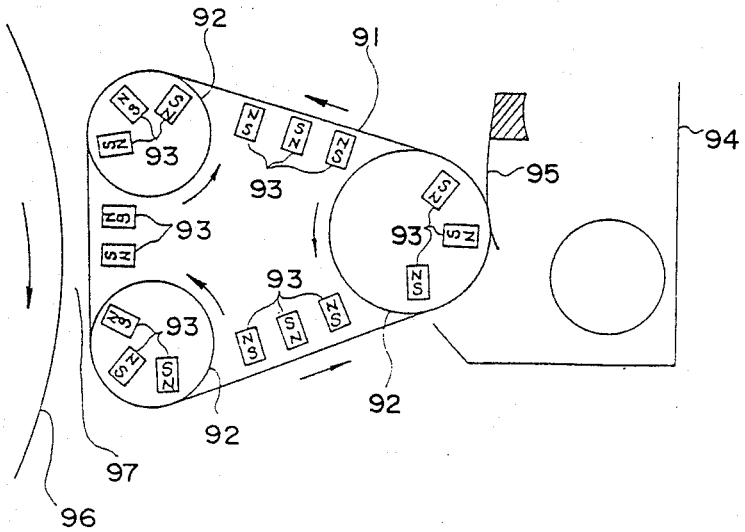
FIG. 10 is a schematic diagram showing another structure of the developing apparatus having the developer layer forming apparatus of the present invention.

FIG. 10 shows the case in which a conductive, non-magnetic belt 91 is used as the developer carrying member. This belt 91 is held on non-magnetic cylinders 92 having magnets 93 therein and are turned in the directions of arrows by the drive source or either of the cylinders 92. Other magnets 93 are also arranged between the cylinders 92 to hold the developer on the belt 91 together with the magnets 93 disposed in the cylinders 92.

An elastic plate 95 according to the present invention is held in abutting contact with the cylinder 92 which is disposed in the vicinity of a developer reservoir 94 so that a thin layer of the developer is formed on the belt 91 like the other embodiments. The magnets 93 in the cylinders 92 may be either fixed, as shown, or made of rotating magnet rolls.

The belt 91 is supplied with a developing bias by any of the cylinders or not-shown another means to develop an electrostatic latent image on an image retainer 96 in the vicinity of the image retainer 96.

With this structure, the degree of freedom of the arrangement of the image retainer 96 and the developer reservoir 94 can be increased, and a region 97 capable of contributing to the development can be made wider to enhance the developing efficiency.

Thanks to the use of the layer forming elastic member made of rubber in the developer layer forming apparatus of the present invention , as has been described hereinbefore, the contact area in case the magnetic carrier or toner is brought into pressure contact with the developer carrying member is made wider by the elasticity of the rubber than that in case of the metallic elastic member so that the pressure per unit area is dropped to prevent the magnetic carrier and toner from being broken. The phenomenon that the broken pieces would otherwise stick to or deposit on the leading end of the elastic member to block the entrance of the developer to accordingly eliminate the developing streaks due to the stick or deposition so that a high-quality image can be obtained for a long period.

Other embodiments of the present invention will be described in the following with reference to the accompanying drawings.

Figure 11A:
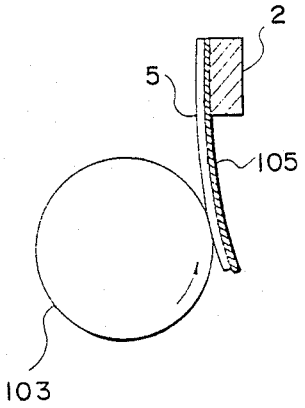
FIGS. 11(*a*) and 11(*b*) are schematic diagrams for explaining elastic members according to other embodiments of the present invention.
Figure 3:
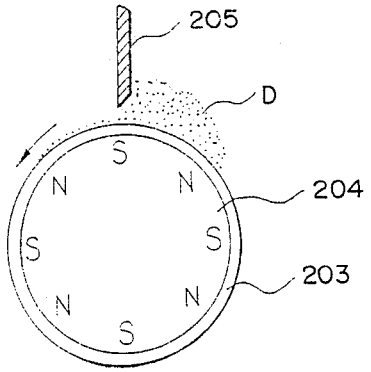
FIG. 3 PRIOR ART
FIG. 3 is a sectional diagram showing the conventional means for regulating the layer thickness of the developer layer.
Figure 11B:
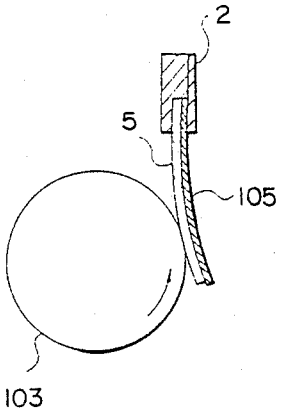
Figure 4:
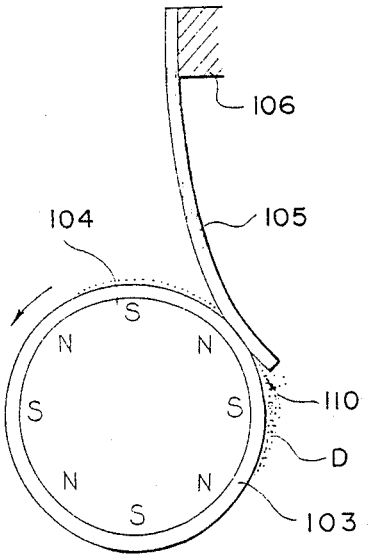
FIG. 4 is a side elevation showing the developer layer forming means of the type in which the elastic plate is brought into pressure contact.
Figure 5:
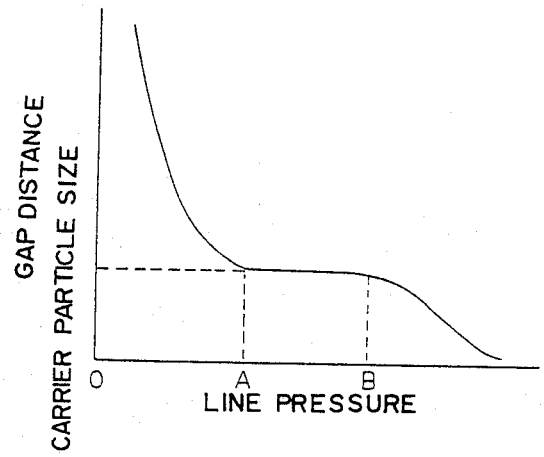
FIG. 5/is a graph plotting the relation between the gap distance and the line pressure of the structure of FIG. 4.
Figure 6:
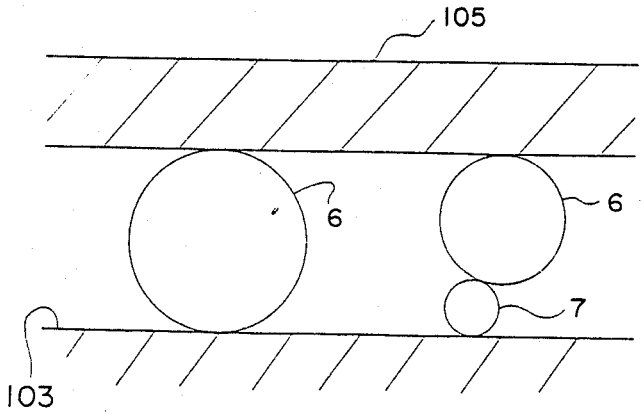
FIG. 6 is a schematic diagram showing the state in which the magnetic carrier and toner sandwiched between the metallic elastic plate and the developer carrying member is pin-pointed.
Figure 7:
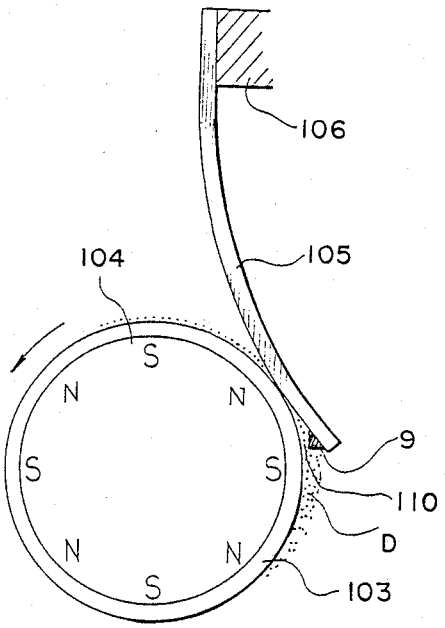
FIG. 7 is a schematic diagram showing the state in which the broken pieces of the magnetic carrier and toner stick to and deposit on the leading end portion of the metallic elastic plate used.
Figure 8:
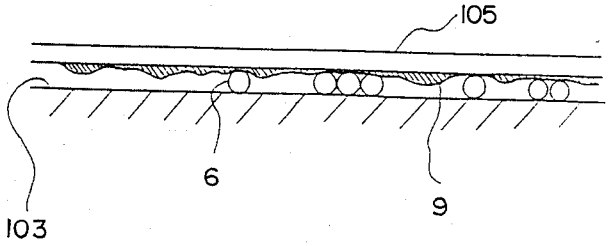
FIG. 8 is a schematic diagram for explaining the state of the sticking deposition in the widthwise direction of the metallic elastic plate.
Figure 9:
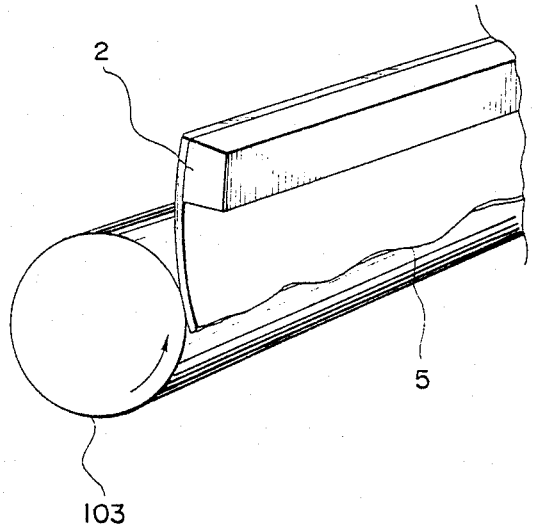
FIG. 9/is a schematic diagram showing the undulating state of the elastic rubber member.

FIGS. 11(*a*) and 11(*b*) are schematic diagrams showing the other embodiments of the present invention. In these embodiments, the elastic plate 105 made of a metal or synthetic resin is further used.

In the embodiment of FIG. 11(*a*), the elastic rubber plate 5 is made of urethane rubber or the like having a thickness of 0.1 to 2.0 mm and a hardness of 40° to 90° Hs. The elastic plate 105 is made of either a metal plate of phosphor bronze or stainless steel having a thickness of 0.05 to 0.5 mm or a resin plate of PET having a thickness of 0.1 to 1.0 mm. These elastic rubber plate 5 and the elastic plate 105 are adhered to each other by an adhesive or thermally fusing and together to the elastic plate holding member 2 by means of double-coated tape. This tape may be replaced by an adhesive.

FIG. 11(*b*) shows another embodiment in which the elastic rubber plate 5 and the elastic plate 105 are not adhered but superposed and are mechanically clamped by the elastic plate holding member 2.

The pressing force and the length of free end of the elastic plate are so determined that the contact position and the amount of deformation of the elastic plate are shown in the region A in FIG. 13.

The process to determine the pressing force and the length of free end of the elastic plate is shown in the Japanese patent application Nos. 34318/86 and No. 34319/86.

In this embodiment, the portion of the elastic plate which comes into contact with the toner or carrier is backed with an elastic rubber member, so that the elastic plate can be pressed uniformly to the developer carrying member and no sticking deposition of the carrier or toner is occurred.

Accordingly, a uniform developer layer can be formed stably.

In either embodiment, the elastic rubber plate 5 is held by the elastic plate 10 of a metal or synthetic resin with more or less distortion, when it is adhered or clamped, so that it can be prevented from undulating, thus forming an even developer layer stably for a long period.

FIG. 12 shows another embodiment of the developer layer forming means wherein an elastic rubber member is attached only a portion of the metal or synthetic resin elastic plate 105 which comes into contact with the developer carrying member so as to comply with the region A in FIG. 13. In the embodiment shown in FIG. 12, the elastic rubber member is made of urethane etc. having a hardness of 40°–90° Hs, preferably 30°–70° Hs and a thickness of 1–3 mm and the elastic plate is fixed on the holding means. According to this embodiment, the developer layer can be formed stably and the distortion of the elastic plate can be compensated.

In this embodiment of the developer layer forming apparatus of the present invention, as has been described hereinbefore, the elastic rubber member to come into contact with the developer carrying member to form the developer layer has a structure in which the plate-shaped elastic member of the metal or synthetic resin is superposed in the adhered form or in a plane contact form on the opposite surface to the contact surface. As is different from the case of the elastic rubber member only, the undulations can be prevented to form an even developer layer for a long period to provide a high-quality image.

Further, the deformation of the elastic plate which is liable to occur in the elastic plate consisting of an elastic rubber can be prevented by backing the elastic rubber plate with a metal or resin plate or by using an elastic rubber member of increased thickness.

What is claimed is:

1. A developing apparatus for developing an image, using a two component developer containing magnetic carrier particles and non-magnetic toner particles, wherein a surface of an image retainer is not in contact with a developer layer formed on a developer carrying member, said apparatus comprising agitating means for mixing said two component developer, said developer carrying member adapted to transfer mixed developer to a developing region, a magnetic member arranged inside said developer carrying member and, developer regulating means for regulating region, said developer regulating means having a pressing contact portion pressed against said developer carrying member by a predetermined force, the surface of said pressing contact portion being formed by an elastic plate member having a fixed end and a free end, said free end projecting a predetermined length from said pressing contact portion upstream of said developer carrying member in a rotary direction thereof.

2. A developer layer forming apparatus according to claim 1, wherein the projecting length is preferably 0.5–3.0 mm.

3. A developer layer forming apparatus according to claim 1, wherein a line pressure at the pressure contact portion is 0.2–20 g/mm.

4. A developer layer forming apparatus according to claim 3, wherein said line pressure is preferably 0.5–10 g/mm.

5. A developer layer forming apparatus according to claim 4, wherein said line pressure is more preferably 1–4 g/mm.

6. A developer layer forming apparatus according to claim 1, wherein said elastic rubber member has a hardness of 40°–90° Hs.

7. A developer layer forming apparatus according to claim 6, wherein said hardness is preferably 50°–75° Hs.

8. A developer layer forming apparatus according to claim 1, wherein said plate member has a plurality of layers different in resiliency from one another.

9. A developer layer forming apparatus according to claim 8, wherein the number of said layers is two.

10. A developer layer forming apparatus according to claim 9, wherein said layers consist of an elastic rubber layer and a metal or resin layer.

11. A developer layer forming apparatus according to claim 1, wherein said plate member is an elastic rubber member having a thickness of 1–3 mm.

* * * * *